US006021569A

United States Patent [19]

Bannister et al.

[11] Patent Number: 6,021,569

[45] Date of Patent: Feb. 8, 2000

[54] RETROFITTING COAL-FIRED POWER GENERATION SYSTEMS WITH HYDROGEN COMBUSTORS

[75] Inventors: Ronald Leo Bannister, Winter Springs, Fla.; Richard Allen Newby, Pittsburgh, Pa.

[73] Assignee: Siemens Westinghouse Power Corporation, Orlando, Fla.

[21] Appl. No.: 08/847,135

[22] Filed: Apr. 30, 1997

[51] Int. Cl.[7] ..... B23P 15/00

[52] U.S. Cl. ..... 29/888; 29/401.1

[58] Field of Search ..... 29/401.1, 888; 60/39.02

[56] References Cited

U.S. PATENT DOCUMENTS

| | | | |
|---|---|---|---|
| 4,910,963 | 3/1990 | Vanzo | 60/641.8 |
| 5,660,037 | 8/1997 | Termuehlen | 60/39.02 |
| 5,666,800 | 9/1997 | Sorensen et al. | 60/39.02 |
| 5,715,671 | 2/1998 | Griffiths | 60/39.02 |

FOREIGN PATENT DOCUMENTS

| | | | |
|---|---|---|---|
| 2511911 | 10/1976 | Germany | F01K 25/00 |
| 2554994 | 6/1977 | Germany | F23C 1/04 |

OTHER PUBLICATIONS

Collins, S: "World's First Nuclear–To–Coal Conversion a Success" vol. 136, No. 4, Apr. 1992.

Malyshenko et al., "Thermodynamic Aspects of the Use of Hydrogen for Solving Certain Problems Facing the Power Industry", *Thermal Engineering*, 1986, 33(10), 553–557.

*Primary Examiner*—I. Cuda

*Attorney, Agent, or Firm*—Eckert Seamans Cherin & Mellott, LLC

[57] ABSTRACT

A method of retrofitting a power generation system having a coal-fired steam boiler, a steam turbine system, and a condenser comprising installing a hydrogen-fired combustion system therein having the step of replacing the coal-fired steam boiler with a hydrogen-fired combustion system such that a steam flow generated by the hydrogen-fired combustion system is directed to the steam turbine system. Another method of retrofitting a power generation system has the steps of installing a hydrogen-fired combustion system to receive the steam flow, a hydrogen stream, and an oxygen stream, and to produce a super-heated steam flow therefrom; and installing a new steam turbine system capable of receiving and expanding said super-heated steam flow and directing said expanded super-heated steam flow to at least a portion of said original steam turbine system.

6 Claims, 3 Drawing Sheets

RETROFITTING COAL-FIRED POWER GENERATION SYSTEMS WITH HYDROGEN COMBUSTORS

BACKGROUND OF THE INVENTION

This invention relates to power generation systems. More specifically, this invention relates to power generations systems that use steam to generate power.

Coal-fired steam boilers are currently used in conjunction with steam turbine systems for generating power, such as electricity. Referring to prior art FIG. 1, a prior art power generation system 10 has a coal-fired steam boiler 12, a steam turbine system 14, a condenser 16, and a fume cleaning system 23. A coal flow 18 and an air stream 20 is directed into the coal-fired steam boiler 12. The coal flow 18 is combusted in the boiler 12 to generate thermal energy and a boiler emission stream 22. The boiler emission stream 22 passes through the fume cleaning system 23 to produce a cleaner emission stream 25. A water flow 24 is directed through an enclosed manifold 26 in the boiler 12 and retains a portion of the thermal energy generated, thereby producing a steam flow 28. The steam flow 28 is directed through, and expanded in, the steam turbine system 14 that has a high pressure turbine 30, an intermediate pressure turbine 32, and a low pressure turbine 34, serially arranged on a shaft 36 that is connected to a generator 38. The expanding steam flow 28 causes the turbines and shaft to rotate, that in turn generates electricity via the generator 38. A fully expanded steam flow 40 exits the low pressure turbine 34 and is condensed in condenser 16 to form the water flow 24. A make-up water feed 42 augments the water flow 24 as needed. This is only a general flow chart of a power generation system and other systems may have other arrangements.

The prior art power generation system 10 that uses coal-fired boilers 12 have pollution and efficiency problems. The coal-fired boilers produce regulated emissions such as $NO_x$, $SO_x$, particulates, topic species, and greenhouse gas emissions. A number of attempts have been made to reduce the amount of regulated emissions from coal-fired steam boilers. Low $NO_x$ burners have been used in the boilers to reduce the $NO_x$ levels in the emissions. The fume cleaning system 23 may include scrubbers to remove the $SO_x$ and a stack glass fabric filter (baghouse) to remove the particulates. The regulated emission removal requirements are expensive to install and generally lower the overall plant efficiency. In addition, the species, green-house gases and other emissions components cannot be readily reduced with current technology. Further, the efficiency of the prior art generation systems 10 that uses coal-fired boilers 12 is limited by the energy of the steam generated. The highest typical superheat stream temperature from a boiler is about 1000° F., with advanced boiler designs producing 1200° F. steam. If the efficiencies were increased, then less coal would need to be burned, thus reducing the pollution emissions.

However, numerous prior art power generation systems that use coal-fired boilers exist, representing an enormous capital investment. Therefore, a need exists to generate power with higher efficiency and less pollution while retaining the capital investment of the existing power generation systems.

SUMMARY OF THE INVENTION

In a power generation system having a coal-fired steam boiler, a steam turbine system, and a condenser, an embodiment of the claimed invention provides a method of retrofitting having the step of replacing the coal-fired steam boiler with a hydrogen-fired combustion system such that a steam flow generated by the hydrogen-fired combustion system is directed to the steam turbine system. Another embodiment of the claimed invention provides a method of retrofitting a power generation system having the steps of installing a hydrogen-fired combustion system to receive the steam flow, a hydrogen stream, and an oxygen stream, and to produce a super-heated steam flow therefrom; and installing a new steam turbine system capable of receiving and expanding said super-heated steam flow and directing said expanded superheated steam flow to at least a portion of said original steam turbine system.

BRIEF DESCRIPTION OF THE DRAWINGS

Prior Art

DETAILED DESCRIPTION OF THE PREFERRED EMBODIMENTS

Figure 1:
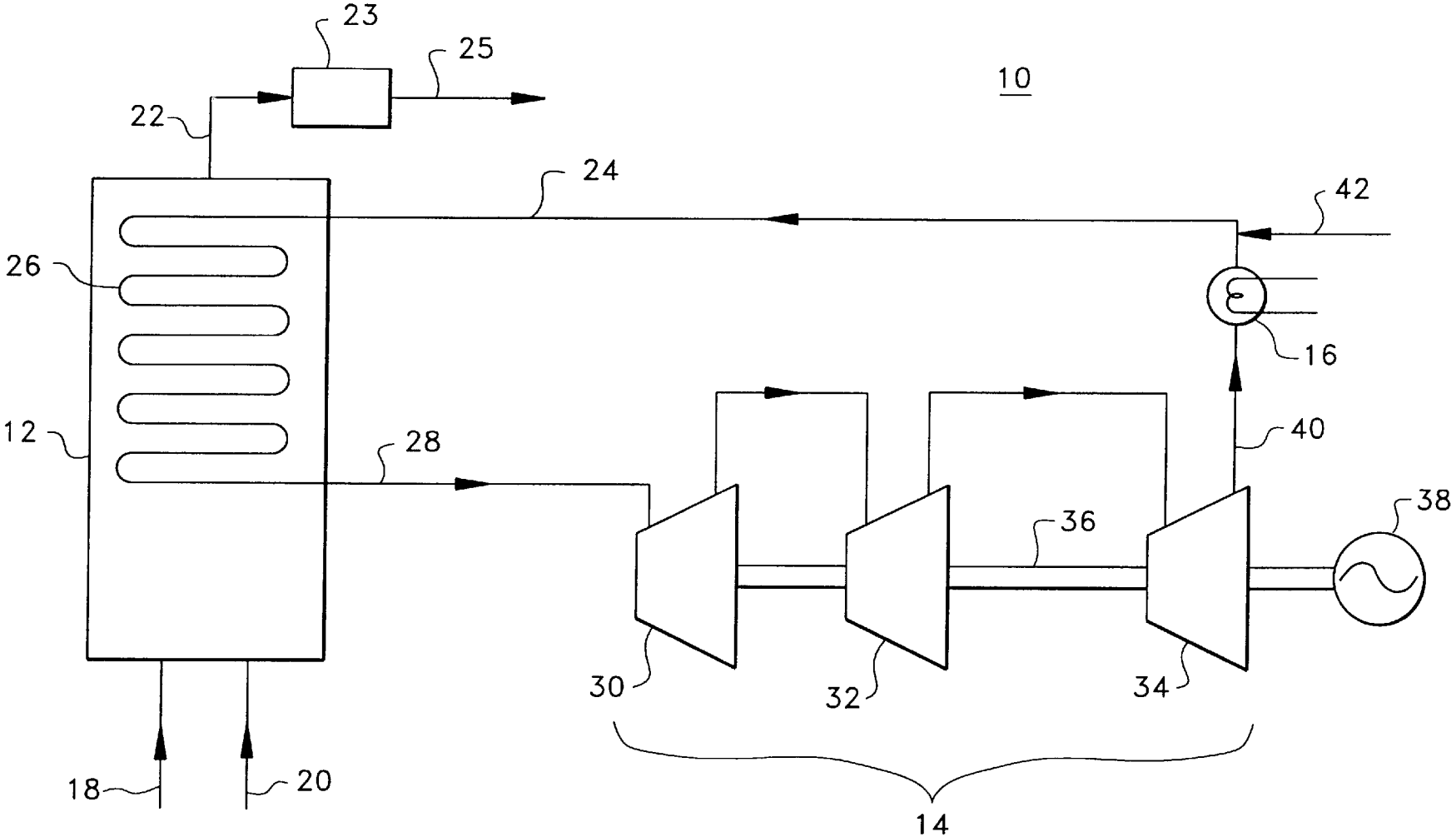
FIG. 1 (PRIOR ART)
FIG. 1 shows a prior art power generation system schematic with a coal-fired steam boiler.
Figure 2:
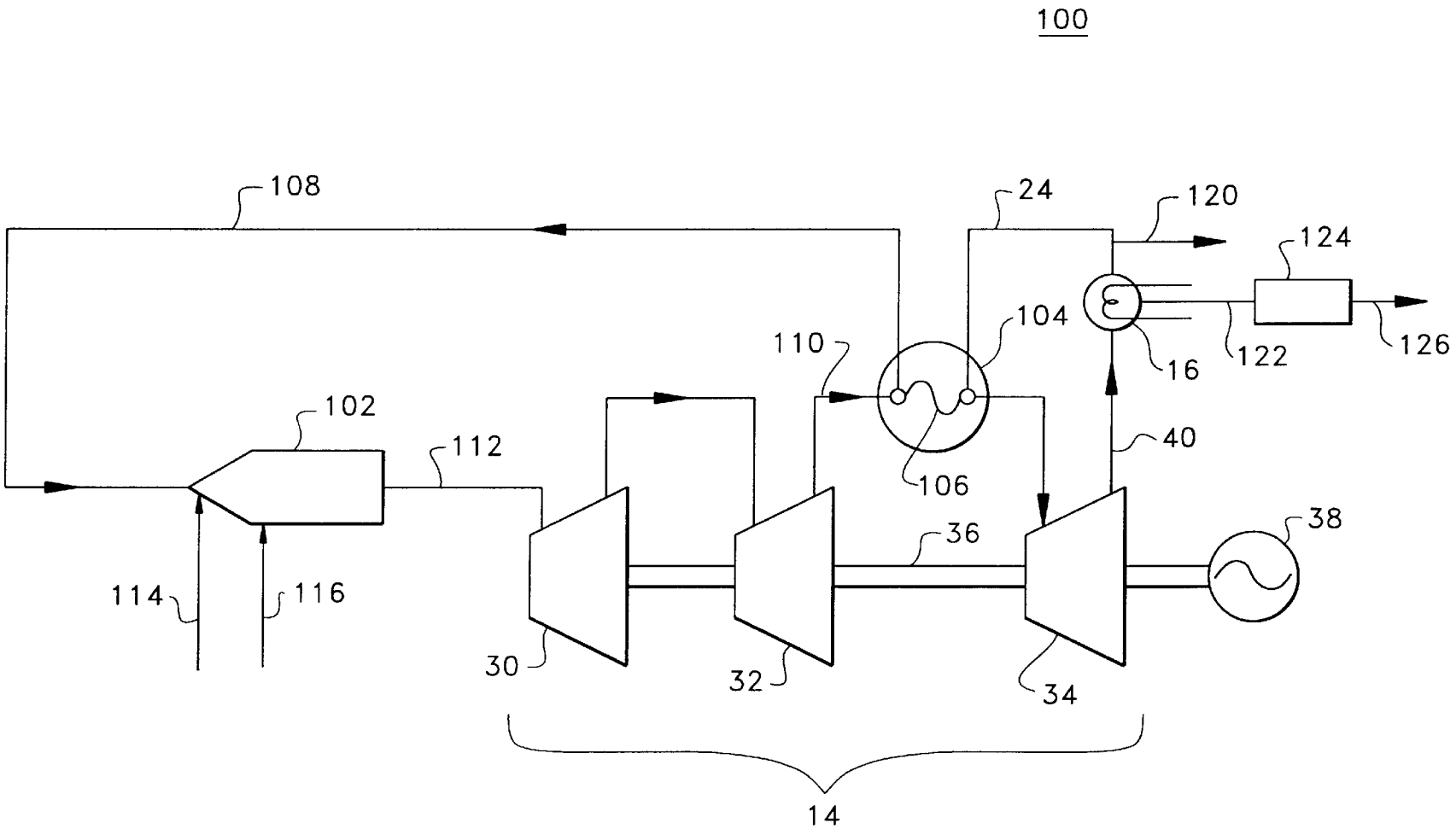
FIG. 2 is a schematic of the prior art power generation system retrofitted with hydrogen-fired combustion system replacing the coal-fired steam boiler.

Referring to the drawings, wherein like reference numerals refer to like elements, and referring specifically to FIG. 2, a retrofitted power generation system 100 comprises the steam turbine system 14 and the condenser 16 of the prior art power generation system 10 with a hydrogen-fired combustion system 102 replacing the coal-fired steam boiler 12. The system has also been retrofitted with a heat exchanger 104 having an enclosed water manifold 106 that receives the water flow 24. A steam line 110 that extends from the intermediate pressure turbine 32 to the low pressure turbine 34 passes through the heat exchanger 104, permitting the transfer of thermal energy from the expanded steam line 110 to the water flow 24 in the enclosed water manifold 106. The heated water flow 24 exits the heat exchanger 104 as a steam/water flow 108. Other embodiments of the invention may not have a heat exchanger or may have one or more heat exchangers in other arrangements with the retrofitted power generation system 100.

The hydrogen-fired combustion system 102 is connected to the steam/water flow 108, along with a hydrogen stream 114 and an oxygen stream 116. The hydrogen stream 114 is combusted in the combustion system 102, thereby producing a super-heated steam flow 112 of approximately 1200° F. to 1600° F. The steam flow 112 is directed to the high pressure turbine 30 of the steam turbine system 14. If the hydrogen stream 114 and the oxygen stream 116 are pure, the $NO_x$, $SO_x$, particulates, topic species, and green-house gas emissions would be zero. Further, the generation of solid waste and liquid/sludge wastes should be negligible relative to those types of emissions produced by the prior art power generation system 10 with the coal-fired steam boiler 12.

Other embodiments of the invention may generate waste that may need to be disposed of properly or processed. To create and maintain low emission levels from the retrofitted power generation system 100, it is necessary to understand how impurities may enter the proposed system and then determine how to minimize the levels within the system. For example, impurities maybe introduced with the hydrogen stream 114 and the oxygen stream 116, through the condenser, or internally by corrosion of materials in the flow path. Control of many of the contaminants can be addressed at the condenser 16 and a bleed 120. The condenser 16 may separate out pollutants from off-gases 122, constituting non-condensable gases and vapors, from the fully expanded steam flow 40 for recycling or disposal in some embodiments of the invention. The recycling and disposal may involve processing the off-gases 122 with a fume cleaning system 124 to produce reduced pollutant off-gases 126. Other embodiments of the invention may not process the off-gases 122 or may modify existing fume cleaning systems 124 to accommodate changes in the fully expanded steam flow 40 as a result of combusting hydrogen. The bleed 120 off of the water flow 24 releases the excess water in the system generated by the hydrogen combustion, along with another portion of the contaminants in the system. In the preferred embodiment of the invention, the sum of the pollutants released by the retrofitted power generation system 100 is equal to or less than the sum of the pollutants released by the prior art power generation system 10 being operated to produce a similar amount of electricity, as a result of combusting hydrogen and not coal.

Figure 3:
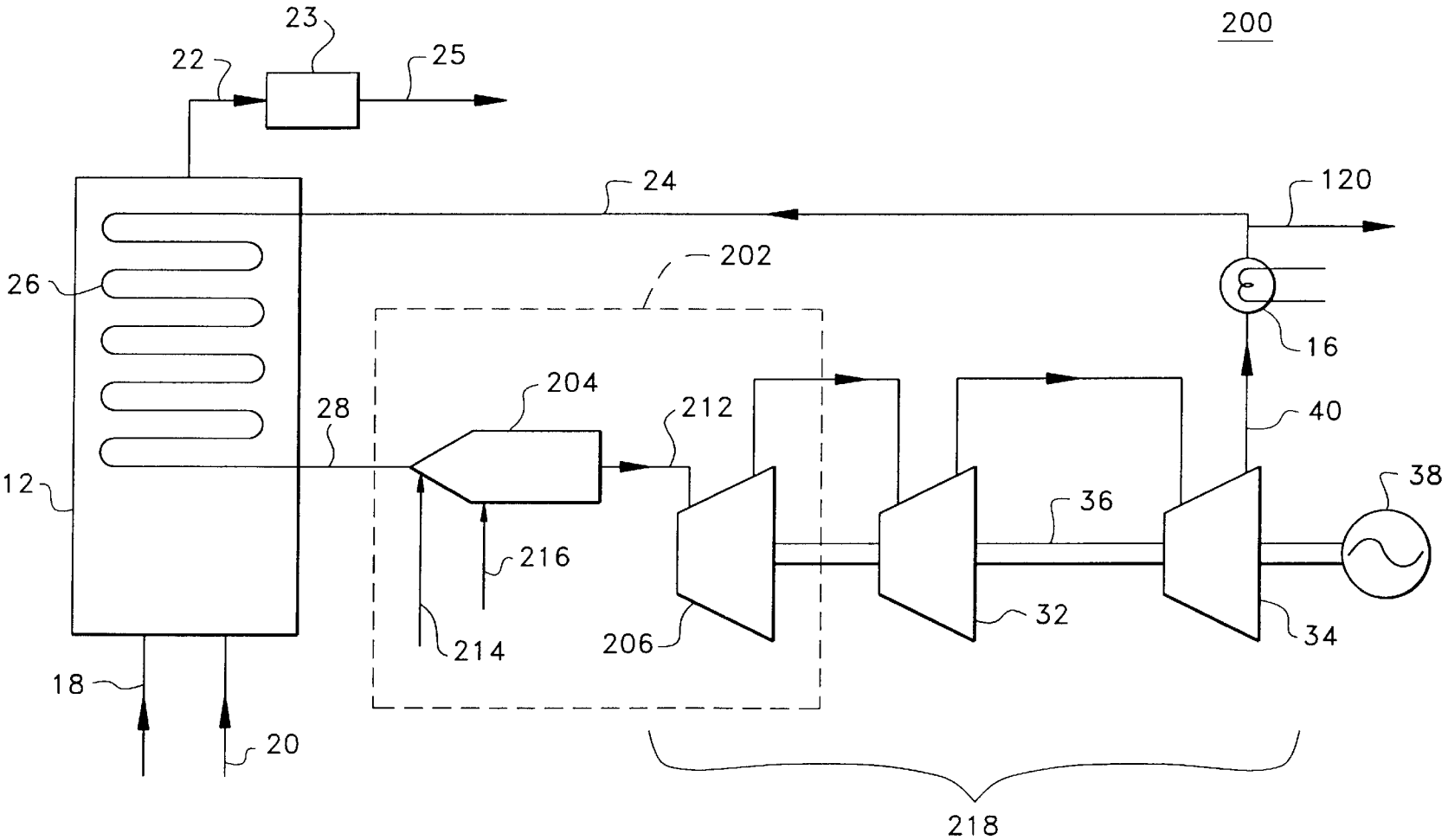
FIG. 3 is a schematic of the prior art power generation system retrofitted with hydrogen-fired combustion system between the coal-fired steam boiler and the steam turbine system.

Now referring to FIG. 3, a retrofitted power generation system 200 according to another embodiment of the invention replaces the high pressure turbine 30 of the prior art power generation system 10 with a retrofit package 202 comprising a hydrogen-fired combustion system 204 and a new high pressure turbine 206. The steam flow 28 is directed into the hydrogen-fired combustion system 204, along with a hydrogen stream 214 and an oxygen stream 216. The hydrogen stream 214 is combusted therein to produce a super-heated steam flow 212 of approximately 1200° F. to 1600° F. The steam flow 212 is directed to the new high pressure turbine 206. The new high pressure turbine 206, that is now part of the new steam turbine system 218, is designed to expand the super-heated steam flow 212 such that the flow may be received by the intermediate pressure turbine 32. Other embodiments of the invention may replace more than just the high pressure turbine 30 with a new turbine or turbines.

In a preferred embodiment of the invention, the sum of the pollutants released by the retrofitted power generation system 200 is equal to or less than the sum of the pollutants released by the prior art power generation system 10 being operated to produce a similar amount of electricity, as a result of combusting hydrogen along with the coal. Other embodiments of the invention may not burn as much coal, thus allowing a reduction in the operations of the fume cleaning system 23 and a resulting cost savings therefrom. Other embodiments of the invention may have the off-gases from the condenser 16 treated as described in connection with the embodiment of the invention shown in FIG. 2.

The present invention may be practiced with power generation systems having more or less than three turbines, more that one steam turbine system, and more than one coal-fired steam boiler. Also, the hydrogen-fired combustion systems may be more than one combustor. Further, to "replace" a component of the power generation system is equivalent to taking an original component out of the process cycle and substituting a new component in its place while not physically removing the original component. Additionally, in a preferred embodiment of the invention, the retrofitted power generation system results in reduce pounds of pollutants/kW in emissions compared to the original power generation system. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. In a power generation system comprising a coal-fired steam boiler, a multi-stage steam turbine system, and a condenser a method of retrofitting comprising the steps of:

a. replacing the coal-fired steam boiler with a hydrogen-fired combustion system such that a steam flow generated by the hydrogen-fired combustion system is directed to the multi-stage steam turbine system, b. connecting a steam/water flow, a hydrogen stream, and an oxygen stream to said hydrogen-fired combustion system, c. connecting a water flow to an inlet of an enclosed water manifold of a heat exchanger between stages of the multi-stage steam turbine system to transfer thermal energy from a first stage of the steam turbine system to a steam/water flow and to a second stage of the steam turbine system, and d. connecting said steam/water flow to a steam/water outlet of said enclosed water manifold, wherein said water flow is connected to the condenser.

2. The retrofitting method of claim 1 further comprising the steps of:

a) removing a boiler fume cleaning system for removing at least a portion of pollutants in a coal-fired steam boiler emission stream; and b) installing a condenser fume cleaning system for processing off-gases released by the condenser.

3. The retrofitting method of claim 1 further comprising the steps of:

a) removing a boiler fume cleaning system for removing at least a portion of pollutants in a coal-fired steam boiler emission stream; and b) modifying an existing condenser fume cleaning system for processing off-gases released by the condenser to accommodate changes in the fully expanded steam flow as a result of combusting hydrogen.

4. A method to reduce pounds of pollutants/Kw in emissions of a power generation system comprising a coal-fired steam boiler, a steam turbine system, and a condenser, comprising the steps of:

a. retrofitting the power generation system by replacing the coal-fired steam boiler with a hydrogen-fired combustion system such that a steam flow generated by the hydrogen-fired combustion system is directed to the multi-stage steam turbine system, b. connecting a steam/water flow, a hydrogen stream, and an oxygen stream to said hydrogen-fired combustion system, c. connecting a water flow to an inlet of an enclosed water manifold of a heat exchanger between stages of the multi-stage steam turbine system to transfer thermal energy from a first stage of the steam turbine system to a steam/water flow and to a second stage of the steam turbine system, d. connecting said steam/water flow to a steam/water outlet of said enclosed water manifold, wherein said water flow is connected to the condenser, and e. operating said retrofitted power generation system.

5. The method of claim 4 wherein said operating step comprises the step of generating a steam flow of approximately 1200° F. to 1600° F. by the hydrogen-fired combustion system.

6. In a power generation system comprising a coal-fired steam boiler, a steam turbine system, a condenser, a method of retrofitting comprising the steps of:

a. adding a hydrogen-fired combustion system such that a steam flow generated by the hydrogen-fired combustion system is directed to the steam turbine system b. connecting a steam/water flow, a hydrogen stream, and an oxygen stream to said hydrogen-fired combustion system, c. connecting a water flow to an inlet of an enclosed water manifold of a heat exchanger between stages of the multi-stage steam turbine system to transfer thermal energy from a first stage of the steam turbine system to a steam/water flow and to a second stage of the steam turbine system, and d. connecting said steam/water flow to a steam/water outlet of said enclosed water manifold, wherein said water flow is connected to the condenser.

* * * * *